United States Patent [19]

Wheeler

[11] 4,254,900

[45] Mar. 10, 1981

[54] BABY LIFT CARRIER AND PAD ASSEMBLY

[76] Inventor: Ralph Wheeler, 12380 NW. 30 Place, Sunrise, Fla. 33323

[21] Appl. No.: 116,749

[22] Filed: Jan. 30, 1980

[51] Int. Cl.[3] ..... A47D 13/02

[52] U.S. Cl. ..... 224/158; 224/49

[58] Field of Search ..... 224/158, 137, 55, 49, 224/157, 159; 150/1.5, 52 C

[56] References Cited

U.S. PATENT DOCUMENTS

| | | | |
|---|---|---|---|
| D. 138,791 | 9/1944 | Horckitz | 224/137 X |
| 1,462,879 | 7/1923 | Barto | 224/49 |
| 2,411,331 | 11/1946 | Nettleship | 224/159 |
| 2,551,509 | 5/1951 | Smith | 224/137 |
| 2,554,340 | 5/1951 | Maxwell | 224/137 |
| 2,689,672 | 9/1954 | Thompson | 224/158 |
| 4,149,687 | 4/1979 | Nunemacher | 224/159 |

*Primary Examiner*—Steven M. Pollard
*Attorney, Agent, or Firm*—Arthur W. Fisher, II

[57] ABSTRACT

A baby lift, carrier and pad assembly specifically structured to allow lifting and/or transporting of a baby or infant comprising a base and a tail portion attached thereto, both of which are formed from a flexible material thereby allowing portions of the assembly to be disposed in a folded over relationship in at least partially covering position relative to an infant disposed on the inter surface of the assembly. A liner sheet or element is disposed on the interior of the assembly and is formed from a liquid impermeable material thereby preventing transfer or passage of liquid through the interior of the assembly from one surface to the other. Structure of the assembly allows its use as a mattress pad, lap pad, crib pad bunting, etc. in addition to providing covering and transfer of an infant.

9 Claims, 3 Drawing Figures

FIG. 1
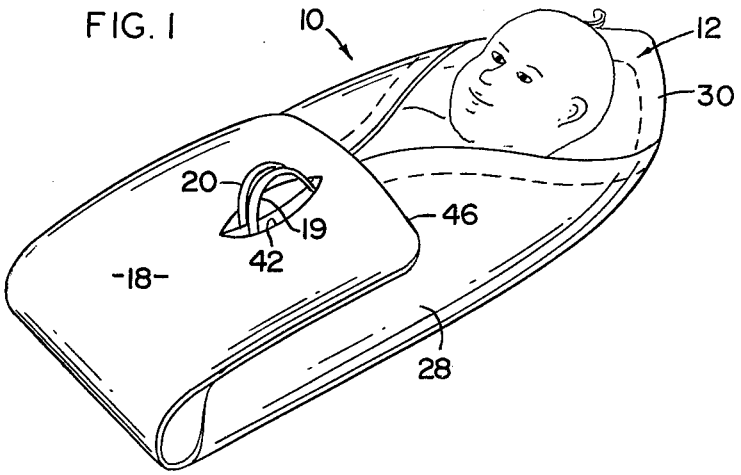
FIG. 2
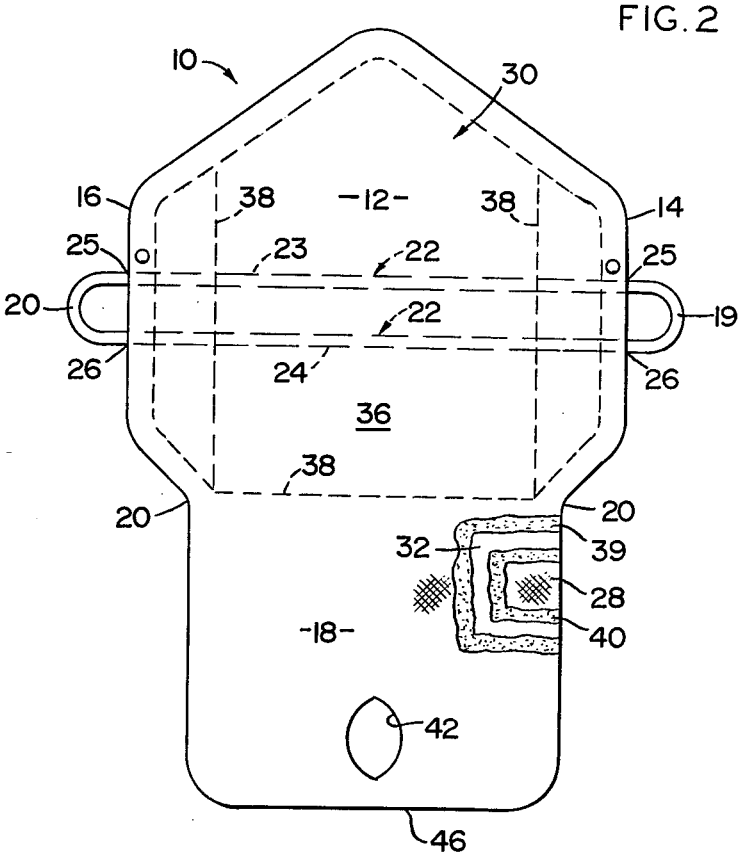
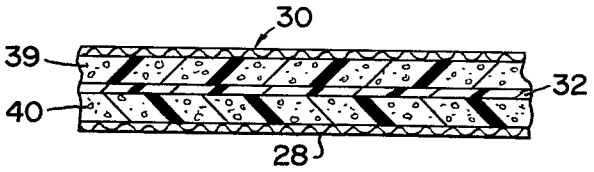
FIG. 3

BABY LIFT CARRIER AND PAD ASSEMBLY

BACKGROUND OF THE INVENTION

1. Field of the Invention

This invention relates to a baby lift, carrier and combination pad assembly to be used with a small infant wherein the assembly is capable of allowing transportation of the infant and otherwise facilitate the handling or transfer of an infant from one location to another while at the same time having operative features of a bunting, mattress, lap, crib or like pad wherein transfer is not required and wherein support and cushioning of the infant on a horizontal surface is desired.

2. Description of the Prior Art

In modern times, numerous products have been developed for the purpose of facilitating the handling and care of very young infants. Such developed products include carriers designed to transport or transfer small infants from one location to another. The majority of such prior art carriers or travelling assemblies are primarily used for the transporting of infants over what may be considered long distances. This eliminates the need to constantly hold or carry the infant. Such devices vary in design from structures including handles for carrying the infant in a "luggage" type fashion. Other prior art devices includes slings, pouches and knap sack like structures for supporting the infant on the shoulders or back of the person supporting the infant.

Specific prior art structures are disclosed in U.S. Pat. Nos. 1,462,897 and 3,096,917.

While the structures disclosed in the above noted patent are functional and certainly operable for the applications indicated they may be considered to lack in versatility by not being readily adaptable for other functions than carrying or supporting the infant for transportation.

Accordingly, there is an obvious need in this area for an assembly which may be used to transfer or carry an infant while at the same time be specifically structured to cushion the infant and be oriented so as to be utilized as a pad for the support of the infant on a mattress, crib, etc. In addition, the assembly should be structured to adequately cover or encase the infant for the purpose of protecting him from the cold or other undesirable elements and thereby provide adequate comfort to the infant to allow the assembly to be used as a sleeping garment or structure.

SUMMARY OF THE INVENTION

The present invention relates to a combination baby lift, carrier and pad assembly to be used with very young infants of the prior to walking age. More specifically the assembly of the present invention comprises a base means structured and configured from a flexible material thereby allowing portions of the base means to be folded at least partially upon itself in covering or overlapping relation to an infant placed on the assembly. The assembly including the base means includes an outer and inter surface portion wherein the inter surface is distinguished from the outer surface by virtue of the proper positioning of the infant and the covering of the infant by the folded over portions of the base means and assembly.

A tail portion is integrally attached to the base means and extends outwardly from one distal end thereof. The tail portion is also formed from a flexible material or preferably the same material from which the base means is formed thereby allowing its disposition in a folded over relation about itself and generally along the longitudinal axis of the assembly. More specifically the tail portion is disposed in an overlapping relation relative to the other portions of the base means which are disposed in their folded over relation.

A primary support portion is defined on the base means and is generally disposed in the approximate center or mid portion of the base means and extends towards the opposite distal end from the tail portion.

A handle means is attached to the base means and is defined at least in part by two handle elements preferably in a loop configuration extending outwardly from oppositely disposed and spaced apart lateral edges of the base means. The handle means may further include an additional support means disposed on the interior of the base means and in interconnecting relation between the outwardly projecting handle elements. This serves to add greater support when the infant is being carried since the main support force is provided by the gripping of the handle element which, as set forth above, are interconnected by the existence of the interiorly disposed support means.

A handle retainer means is mounted or formed on the tail portion and is preferably in the form of an aperture means disposable into surrounding relation to both handle elements as they are brought into adjacent relationship to one another when the base means and tail portions are disposed in their folded over relationship. As will be explained in greater detail hereinafter. The positioning of the handle elements in surrounded relation by the aperture means allows gripping of the entire assembly with the infant maintained therein in an effective and compact manner which eliminates inadvertent escape of the infant from the interior surface of the carrier and pad assembly.

Other structural features of the present invention include the formation of the base means and integrally attached tail portion from a flexible material. This includes the provision of a liner element disposed on the interior of the base means and the tail portion wherein the liner element is formed from a liquid impermeable material such as a flexible plastic or the like. This latter provision prevents transfer of liquid through the interior of the assembly between the inner and outer surfaces. Accordingly, the infant will not be subjected to moisture in the event that the assembly is placed on a moisture laden surface. Also there is no danger of moisture passing from the inter surface to the outer surface of the assembly, due to wetting of the infant as when the assembly is used as a lap pad or mattress pad. Again due to the flexibility of the material from which the assembly is formed the entire assembly structure may be used as a pad for supporting and cushioning the infant on a horizontal surface such as a mattress, etc. In this use the pad is positioned in a flat orientation wherein the handle element may be folded under for safety, etc.

In operation, when the assembly is used as a carrier, the infant is placed on the inter surface such that the mid portion of the body substantially rests on the primary support portion of the base means. This will dispose the shoulders and chest area generally mid way between the handle elements. The lateral edges from which the handle elements extend are then folded inwardly toward the substantial center of the base means to the point where the handle elements are disposed in adjacent, side by side relation to one another. The tail portion is then folded over about its own longitudinal axis to the position where the aperture means may be easily disposed in surrounding relation to the handle elements projecting therethrough. By virtue of this position, the infant is maintained on the inter surface in covered and protected position. In this position, the subject carrier assembly can also be used for gently rocking the infant. Such rocking may be desirable for soothing or comforting the infant prior to placing the infant on his mattress or in his crib for sleep. A common occurence in handling infants of this tender age is the difficulty in placing in the infant on the mattress after he has already fallen asleep in the arms of a holder. Through utilization of the present baby lift carrier and pad assembly, the infant can be rocked until asleep and then gently lifted into the crib and placed on the mattress in the same position in which he fell asleep. Upon resting on the mattress or sleeping surface, the carrier and pad assembly is merely unfolded and positioned substantially flat on the sleeping surface. The assembly is thereby immediately converted to a sleeping pad without disturbing the positioning of the child.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a perspective view of the carrier and pad assembly in its folded position about an infant.

FIG. 2 is a perspective view of the assembly of the present invention in its substantially flat or unfolded position.

FIG. 3 is a sectional view taken along lines 3—3 of FIG. 2.

Similar reference characters refer to similar parts throughout the several views of the drawings.

DETAILED DESCRIPTION OF THE PREFERRED EMBODIMENT

As shown in FIG. 1 and the subject baby lift, carrier, and pad assembly is generally indicated as 10. In FIG. 1 the assembly is shown in its folded over position for covering and carrying an infant on the inside thereof, as will be explained in greater detail hereinafter. With reference to FIGS. 2 and 4 the assembly is shown in its spread out orientation wherein the assembly serves as a mattress pad or the like for support on a horizontal surface.

The assembly 10 comprises a base means 12 defined by oppositely disposed lateral edges 14 and 16. A tail portion generally indicated as 18 is integrally or otherwise attached to a distal end as at 20 to the base means 12 and extends outwardly therefrom along the longitudinal axis of the assembly 10.

Handle means is secured to the assembly and comprises at least two handle elements 19 and 20 extending outwardly from respective lateral edges 14 and 16. These handle elements 19 and 20 are disposed primarily in a loop type configuration and project outwardly from the lateral edges 14 and 16. The handle means further includes support means disposed on the interior of the base means as indicated in broken lines as 22. The handle means extends through the interior of the base means 12 in interconnected relation to each of the handle elements 19 and 20. In the preferred embodiment as best shown in FIG. 4 the support means 22 comprises two support elements 23 and 24 both of which extend through the interior of the base means and interconnect opposite ends as at 25 and 26 of the handle elements 19 and 20.

With reference to FIGS. 1 through 4 it should be noted that the assembly is structured to have an outer surface 28 and an inter surface 30. Preferably these inter and outer surfaces are defined by a surface sheet (not clearly shown) which is preferably formed from a quilted material.

With reference to FIG. 3 a cross sectional configuration of the interior of both the base means and the tail portion is shown. More specifically, the construction of the assembly is such that the outer surface 28 and the inter surface 30 are separated by a liner means in the form of a liner sheet 32 preferably formed from a plastic or like flexible material which is specifically is liquid impermeable. This characteristic effectively provides a water proof barrier between the inter and outer surfaces so that moisture cannot pass between these two surfaces through the interior. Accordingly, moisture caused from the infant will not pass through from the inter surface 30 to the outer surface 28 and thereby dampen or wet any surface on which the assembly is placed while the infant is maintained therein. To the contrary, the infant maintained on the inter surface 30 is protected from any moisture passing through from the outer surface 28. This could easily occur when the assembly, with the infant on the interior thereof, is placed on a wet or moist surface inadvertently. The liner sheet 32 has a substantially equal surface area configuration and dimensions relative to the configuration and dimension of the inter and outer surfaces 30 and 28 respectively. Therefore, the liner sheet 32 effectively extends over most of the lateral surface area of both the inter and outer surfaces 30 and 28 and therefore substantially the entire surface area of the assembly.

Another structural feature of the present invention is the existence of a primary support area generally indicated as 36. This primary support area is primary defined on the inter surface 30 and is more particularly defined by a seam means 38 formed directly on the inter surface 30 which outlines the peripheral boundry of the primary support portion 36. Further it should be noted that this portion 36 coincides with the substantial mid point of the base means as well as the mid point of the support means 23 and 24 defining part of the handle means. Accordingly the main weight of the infant's body or the mid portion thereof is placed on the primary support portion or to be adequately supported by the support means 23 and 24 as the handle elements 19 and 20 are moved to their substantially adjacent position to one another as defined by the folded over position of the entire assembly as best shown in FIG. 1.

Again with reference to FIG. 3, the interior structure of the assembly is such as to provide cushioning means generally in the form of at least one cushioning layer 39 disposed between one surface of the liner sheet 32 and the inter surface 30. The cushion means may also include a second cushion layer 40 disposed between the opposite surface of the liner sheet 32 relative to the first cushion layer 39 and the outer surface 28 of the assembly. The existence of the cushioning means adds additional comfort to the positioning and maintenance of the infant on the inter surface 30. This is especially true, as set forth above, both the inter and outer surfaces, 30 and 28 respectively are defined by a quilted surface sheet configuration (not shown).

With reference to FIGS. 1, the assembly of the present invention further comprises a handle retaining means generally indicated as 42. This handle retaining means is preferably in the form of an aperture means 44 formed in the tail portion at a spaced distance from the distal end 46 thereof. The disposition and dimension and configuration of the aperture means 44 is such as to adequately and comfortably surround the handle elements 19 and 20 when the assembly is disposed in its folded over position as shown in FIG. 1. Accordingly the folded over position is primarily defined by the base means having its lateral edges 14 and 16 folded in towards the center such that the handle elements 19 and 20 are disposed in a side by side substantially adjacent relation to one another again as shown in FIG. 1. The tail portion is then folded over about itself and along the longitudinal axis of the assembly such that the retaining aperture means 44 is disposed over and surrounds both of the handle elements 19 and 20. An infant maintained in the interior of the folded over assembly on the inter surface 30 is thereby securely covered and maintained on the interior of the folded over assembly without fear of inadvertent removal therefrom.

It should be noted that while the assembly 10 is capable of transferring or transporting an infant on the interior thereof, such transfer is primarily designed to be done over short distances. Further in adequately support the infant proper care should be taken to support the infant's head when wrapped in the assembly even though the assembly is structured to support the main weight of the infant's body.

It will thus be seen that the objects set forth above, among those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described,

What is claimed is:

1. A baby lift, and pad assembly of the type primarily designed to be used with infants, said assembly comprising: an inter and an outer surface, base means dimensioned and configured for support of the inant and structure for disposition in at least partially covering relation to the infant, handle means comprising at least one handle element projecting outwardly from each of both spaced apart and oppositely disposed lateral edges, a tail portion attached to and extending from one distal end of said base means, said handle restraining means attached to said tail portion and disposed and configured to engage said handle elements when said tail portion is disposed in its folded over position and when said handle elements are adjacent positioned relative to one another, said handle restraining means comprises an aperture means formed in said tail portion and dimensioned and structured to at least partially surround said handle elements, said handle elements thereby disposed for gripping when protruding through said aperture means, said base means and said tail portion formed from a flexible material and said tail portion disposable in a folded over position back about a portion of the longitudinal axis of said assembly into at least partially overlapping relation to said base means and in retaining position with said handle means, whereby an infant may be maintained in at least partially covered position on said inter surface of said base means.

2. An assembly as in claim 1 wherein said base means comprises a primary support portion extending primarily between said handle elements; liner means mounted on the interior of said base means and including a flexible liquid impermeable material liner sheet disposed between said inter and said outer surface and extending over at least a major portion of the area defining said primary support portion, whereby liquid is prevented from passing through the interior of said base means between said inter and outer surfaces.

3. An assembly as in claim 2 wherein said base means comprises cushion means disposed between at least surface of said liner sheet and one of said inter or outer surfaces of said assembly, said cushion means comprising a layer of compressable material.

4. An assembly as in claim 2 wherein said liner sheet is disposed on the interior of said base means and said tail portion and is configured and dimensioned to cover the majority of the area between said inter and outer surfaces, whereby liquid is prevented from passing through the interior of a major portion of said assembly between said inter and outer surfaces.

5. An assembly as in claim 4 wherein said base means comprises cushion means including two layers of soft compressable material disposed on the interior of said assembly between opposite surfaces of said liner sheets and respectively positioned inner and outer surfaces of said assembly, each layer extending over a major portion of the respective surface of said liner sheet.

6. An assembly as in claim 1 wherein said primary support portion is at least partially defined by seam means formed in said base means and disposed to define a major portion of the perimeter of primary support means.

7. An assembly as in claim 1 wherein said handle means further comprises support means disposed on the interior of said base means and extending across that primary support portion, opposite ends of said support means each secured to one of said oppositely disposed handle elements.

8. An assembly as in claim 1 wherein said tail portion and said base means are integrally attached to one another and both formed from flexible material capable of being folded upon itself in substantially surrounding covering relation to an infant placed on said inter surface; said flexible material assembly further capable of being disposed in a substantially planer orientation in supported position on a substantially horizontal surface, whereby said assembly can be utilized as a carrier or pad with the infant resting on said inter surface.

9. An assembly as in claim 8 further comprising fastening means including a plurality of fastening elements secured to inter surface and said outer surface in predetermined, interengageable position relative to each other, each of said fastening elements structured for mating engagement with at least one other of said fastening elements.

* * * * *